US006016036A

United States Patent [19]

Brailove

[11] Patent Number: 6,016,036

[45] Date of Patent: Jan. 18, 2000

[54] MAGNETIC FILTER FOR ION SOURCE

[75] Inventor: Adam A. Brailove, Gloucester, Mass.

[73] Assignee: Eaton Corporation, Cleveland, Ohio

[21] Appl. No.: 09/014,472

[22] Filed: Jan. 28, 1998

[51] Int. Cl.[7] ..... H01J 27/02; H05H 1/10

[52] U.S. Cl. ..... 315/111.71; 315/111.91; 250/423 R

[58] Field of Search ..... 315/111.71, 111.81, 315/111.91; 290/423 R, 492.21, 492.3

[56] References Cited

U.S. PATENT DOCUMENTS

| | | | |
|---|---|---|---|
| 4,239,594 | 12/1980 | Ohkawa | 176/9 |
| 4,447,732 | 5/1984 | Leung et al. | 250/427 |
| 4,486,665 | 12/1984 | Leung et al. | 250/427 |
| 5,760,405 | 6/1998 | King et al. | 250/423 R |
| 5,825,038 | 10/1998 | Blake et al. | 250/492.21 |

FOREIGN PATENT DOCUMENTS 8-209341 8/1996 Japan .

OTHER PUBLICATIONS

K. W. Ehlers and K. N. Leung (Effect of a magnetic filter on hydrogen ion species in a multicusp ion source) Oct. 1981, Rev. Sci. Instrum., vol. 52, No. 10, pp. 1452–1458.

*Primary Examiner*—Justin P. Bettendorf
*Attorney, Agent, or Firm*—John A. Kastelic

[57] ABSTRACT

A magnetic filter (90) for an ion source (26) is provided. The ion source comprises a housing defining a plasma confinement chamber (76) in which a plasma including ions is generated by ionizing a source material. The housing includes a generally planar wall (50) in which are formed a plurality of elongated apertures (64) through which an ion beam (84) may be extracted from the plasma. The plurality of elongated openings are oriented substantially parallel to each other and to a first axis (66) which lies within the planar wall the first axis being substantially orthogonal to a second axis (68) which also lies within the planar wall. The magnetic filter (90) is disposed within the plasma confinement chamber (76). The magnetic filter separates the plasma confinement chamber into a primary region (86) and a secondary region (88). The magnetic filter comprises a plurality of parallel elongated magnets (90*a*–90*n*), oriented at an angle θ as measured from the second axis (68), and lying in a plane which is generally parallel to the generally planar wall (50).

18 Claims, 8 Drawing Sheets

MAGNETIC FILTER FOR ION SOURCE

FIELD OF THE INVENTION

The present invention relates generally to ion sources for ion implantation equipment and more specifically to a magnetic filter for an ion source.

BACKGROUND OF THE INVENTION

Ion implantation has become a standard accepted technology of industry to dope workpieces such as silicon wafers or glass substrates with impurities in the large scale manufacture of items such as integrated circuits and flat panel displays. Conventional ion implantation systems include an ion source that ionizes a desired dopant element which is then accelerated to form an ion beam of prescribed energy. The ion beam is directed at the surface of the workpiece to implant the workpiece with the dopant element. The energetic ions of the ion beam penetrate the surface of the workpiece so that they are embedded into the crystalline lattice of the workpiece material to form a region of desired conductivity. The implantation process is typically performed in a high vacuum process chamber which prevents dispersion of the ion beam by collisions with residual gas molecules and which minimizes the risk of contamination of the workpiece by airborne particulates.

Conventional ion sources consist of a chamber, which may be formed from graphite, having an inlet aperture for introducing a gas to be ionized into a plasma and an exit aperture through which the plasma is extracted to form the ion beam. In general, the plasma comprises ions desirable for implantation into a workpiece, as well as ions which are not desirable for implantation and which are a by-product of the ionization process. In addition, the plasma comprises electrons of varying energies.

One example of such an input gas is phosphine ($PH_3$) which is utilized to produce positively charged phosphorous ($P^+$) ions for doping the workpiece. The phosphine may be diluted within the source chamber with hydrogen gas, and high energy electrons emitted from an energized filament within the source chamber bombard the mixture. As a result of this ionization process, hydrogen ions are produced which may be extracted through the exit aperture, along with the desired $P^+$ ions, into the ion beam. Thus, the hydrogen ions will be implanted along with the desired ions. If a sufficient current density of hydrogen ions is present, these ions may cause an unwanted increase in the temperature of the workpiece that may actually damage the photoresist on the surface of the substrate.

In order to reduce the number of unwanted ions available for extraction into the ion beam, it is known to provide magnets within the source chamber to separate the ionized plasma. The magnet confines undesirable ions and high energy electrons to the portion of the source chamber away from the exit aperture and confines the desirable ions and low energy electrons to the portion of the source chamber near the exit aperture. Such a magnet arrangement is shown in U.S. Ser. No. 08/756,970 now U.S. Pat. No. 5,760,405 to the assignee of the present invention, incorporated by reference herein as if fully set forth. Other related examples of magnet configurations within an ion source chamber are shown in U.S. Pat. No. 4,447,732 to Leung et al., and Japanese Patent No. 8-209341 to Haraichi. Both of these references show a magnetic filter comprised of a plurality of longitudinally extending magnets oriented parallel to each other.

In applications for implanting large surface areas, such as flat panel displays, a ribbon beam ion source may be utilized.

The ribbon beam is formed using a plurality of elongated exit apertures in the source chamber, as shown in U.S. Ser. No. 08/756,970 now U.S. Pat. No. 5,760,405. The plurality of exit apertures provides the capability for adjusting the width of the ribbon beam, and also provides for greater variability of beam current density and energy than a single aperture would otherwise provide. Each of the plurality of exit apertures outputs a portion of the total ion beam output by the ion source. Beam portions output by apertures located between surrounding apertures overlap the beam portions output by those surrounding apertures.

The use of a magnetic filter such as that shown in U.S. Pat. No. 4,447,732 or Japanese Patent No. 8-209341 in a multiple aperture ribbon beam ion source, however, results in undesirable ion beam current characteristics. Specifically, orientation of the longitudinally extending (columnar) magnets orthogonally with respect to the elongated exit apertures of the ion source results in beam current nonuniformities along the length of the ribbon beam. These current nonuniformities result from regions of increased current, which are output from each aperture nearest, the locations of the magnets. With multiple apertures, and with the orthogonal positioning of the magnets with respect to these apertures, this effect is cumulative for each aperture, resulting in significant variances in total beam current along the length of the ribbon beam. The current non-uniformity can result in non-uniform ion implantation of the workpiece.

Accordingly, it is an object of the present invention to provide a magnetic filter for a ribbon beam ion source, which provides a ribbon ion beam having a uniform current density along the entire length thereof.

It is a further object of the present invention to provide a magnetic filter for an ion source which does not suffer from the undesirable beam current characteristics that are inherent with known ion source magnetic filters.

SUMMARY OF THE INVENTION

A magnetic filter for an ion source is provided. The ion source comprises a housing defining a plasma confinement chamber in which a plasma including ions is generated by ionizing a source material. The housing includes a generally planar wall in which are formed a plurality of elongated apertures through which an ion beam may be extracted from the plasma. The plurality of elongated openings are oriented substantially parallel to each other and to a first axis which lies within the planar wall the first axis being substantially orthogonal to a second axis which lies within the planar wall. The magnetic filter is disposed within the plasma confinement chamber. The magnetic filter separates the plasma confinement chamber into a primary region and a secondary region. The magnetic filter comprises a plurality of parallel elongated magnets, oriented at an angle θ as measured from the second axis, and lying in a plane which is generally parallel to the generally planar wall.

DETAILED DESCRIPTION OF A PREFERRED EMBODIMENT OF THE INVENTION

Figure 1:
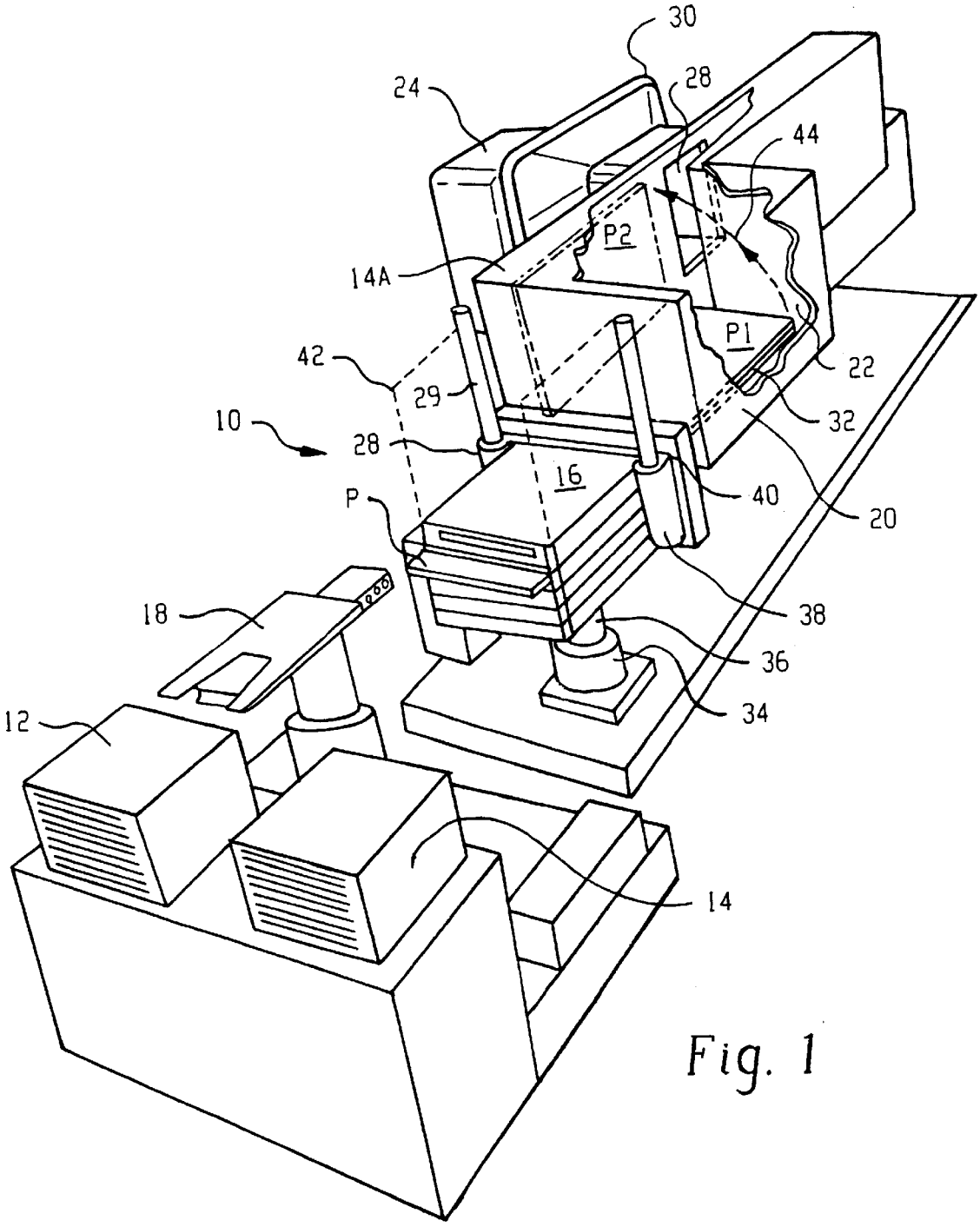
FIG. 1 is a perspective view of an ion implantation system into which an ion source constructed according to the principles of the invention is incorporated.

Referring now to the drawings, FIG. 1 shows an ion implantation system 10 into which the inventive ion source magnetic filter is incorporated. The implantation system 10 shown is used to implant large area substrates such as flat display panels P.

The system 10 comprises a pair of panel cassettes 12 and 14, a load lock assembly 16, a robot or end effector 18 for transferring panels between the load lock assembly and the panel cassettes, a process chamber housing 20 providing a process chamber 22, and an ion source housing 24 providing an ion source 26 (see FIGS. 2–5). Panels are serially processed in the process chamber 22 by an ion beam emanating from the ion source which passes through an opening 28 in the process chamber housing 20. Insulative bushing 30 electrically insulates the process chamber housing 20 and the ion source housing 24 from each other.

A panel P is processed by the system 10 as follows. The end effector 18 removes a panel to be processed from cassette 12, rotates it 180°, and installs the removed panel into a selected location in the load lock assembly 16. The load lock assembly 16 provides a plurality of locations into which panels may be installed. The process chamber 22 is provided with a translation assembly that includes a pickup arm 32 which is similar in design to the end effector 18.

Because the pickup arm 32 removes panels from the same position, the load lock assembly is movable in a vertical direction to position a selected panel, contained in any of its plurality of storage locations, with respect to the pickup arm. For this purpose, a motor 34 drives a leadscrew 36 to vertically move the load lock assembly. Linear bearings 38 provided on the load lock assembly slide along fixed cylindrical shafts 40 to insure proper positioning of the load lock assembly 16 with the process chamber housing 20. Dashed lines 42 indicate the uppermost vertical position that the loadlock assembly 16 assumes, as when the pickup arm 32 removes a panel from the lowermost position in the loadlock assembly. A sliding vacuum seal arrangement (not shown) is provided between the loadlock assembly 16 and the process chamber housing 20 to maintain vacuum conditions in both devices during and between vertical movements of the loadlock assembly.

The pickup arm 32 removes a panel P from the loadlock assembly 16 in a horizontal position P1 (i.e. the same relative position as when the panel resides in the cassettes 12 and 14 and when the panel is being handled by the end effector 18). The pickup arm 32 then moves the panel from this horizontal position P1 in the direction of arrow 44 to a vertical position P2 as shown by the dashed lines in FIG. 1. The translation assembly then moves the vertically positioned panel in a scanning direction, from left to right in FIG. 1, across the path of an ion beam generated by the ion source and emerging from the opening 28.

The ion source outputs a ribbon beam. The term "ribbon beam" as used herein shall mean an elongated ion beam having a length that extends along an elongation axis and having a width that is substantially less than the length and that extends along an axis which is orthogonal to the elongation axis. The term "orthogonal" as used herein shall mean substantially perpendicular. Ribbon beams have proven to be effective in implanting large surface area workpieces because they require only a single unidirectional pass of the workpiece through the ion beam to implant the entire surface area, as long as the ribbon beam has a length that exceeds at least one dimension of the workpiece.

In the system of FIG. 1, the ribbon beam has a length that exceeds at least the smaller dimension of a flat panel being processed. The use of such a ribbon beam in conjunction with the ion implantation system of FIG. 1 provides for several advantages in addition to providing the capability of a single scan complete implant. For example, the ribbon beam ion source provides the ability to process panel sizes of different dimensions using the same source within the same system, and permits a uniform implant dosage by controlling the scan velocity of the panel in response to the sampled ion beam current.

Figure 2:
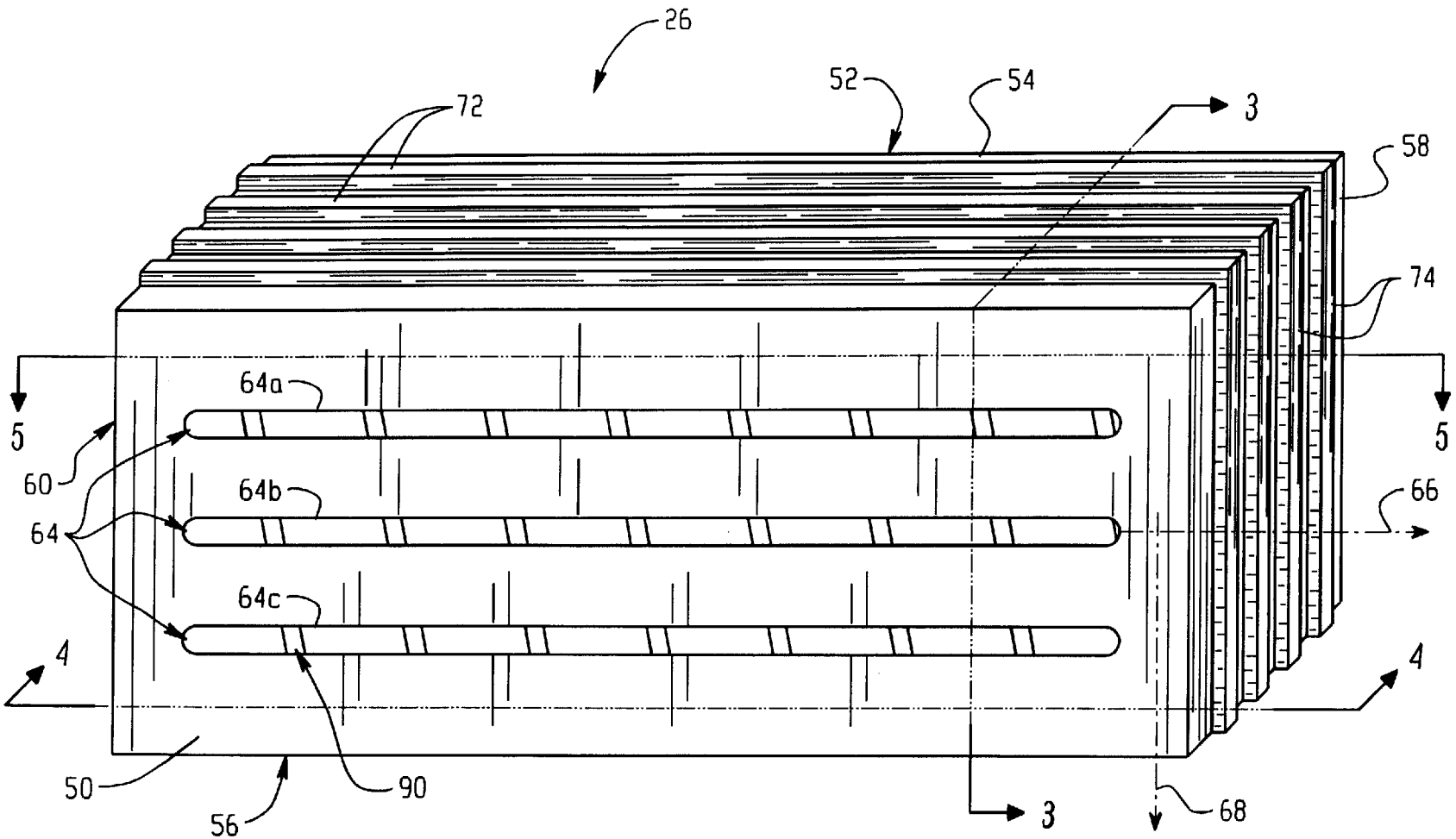
FIG. 2 is a perspective view of an ion source constructed according to the principles of the present invention.

FIGS. 2–5 show the ion source 26 in more detail. FIG. 2 provides a perspective view of the ion source 26 residing within the ion source housing 24 of FIG. 1. As shown in FIG. 2, the ion source 26 generally assumes the shape of a parallelepiped, having a front wall 50, a back wall 52, a top wall 54, a bottom wall 56, and side walls 58 and 60, respectively. From the perspective view provided by FIG. 2, back wall 52, bottom wall 56, and side wall 60 are hidden from view. The walls have exterior surfaces (visible in FIG. 2) and interior surfaces (not shown in FIG. 2) which together form a plasma confinement chamber 76 (see FIG. 3). The back, top, bottom and side walls of the ion source 26 may be comprised of aluminum or other suitable material. Graphite or other suitable material may be used to line the interiors of these walls, as well as to construct the entirety of the front wall 50.

A plurality of elongated apertures 64 are provided in the front wall 50 of the ion source 26. In the illustrated embodiment, three such apertures 64*a*–64*c* are shown, oriented parallel to each other. Each aperture outputs a portion of the total ion beam output by the source 26. Beam portions output by apertures located between surrounding apertures (i.e. the middle aperture) overlap the beam portions output by those surrounding apertures (i.e. the outer apertures). Accordingly, the width of the ion beam output by the ion source may be adjusted by selecting the number and configuration of apertures.

Figure 2A:
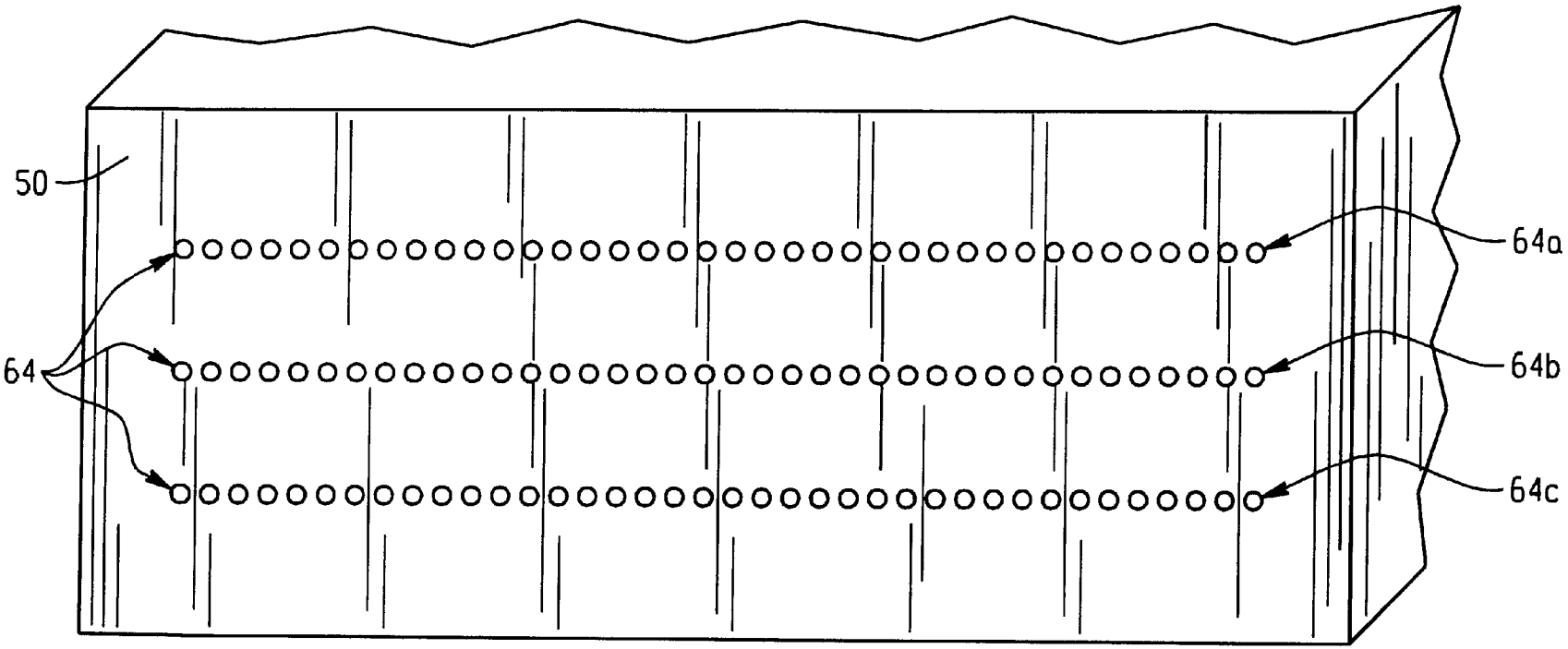
FIG. 2A is an alternative embodiment of the front wall of the ion source of FIG. 2, showing an alternative aperture arrangement.
Figure 4:
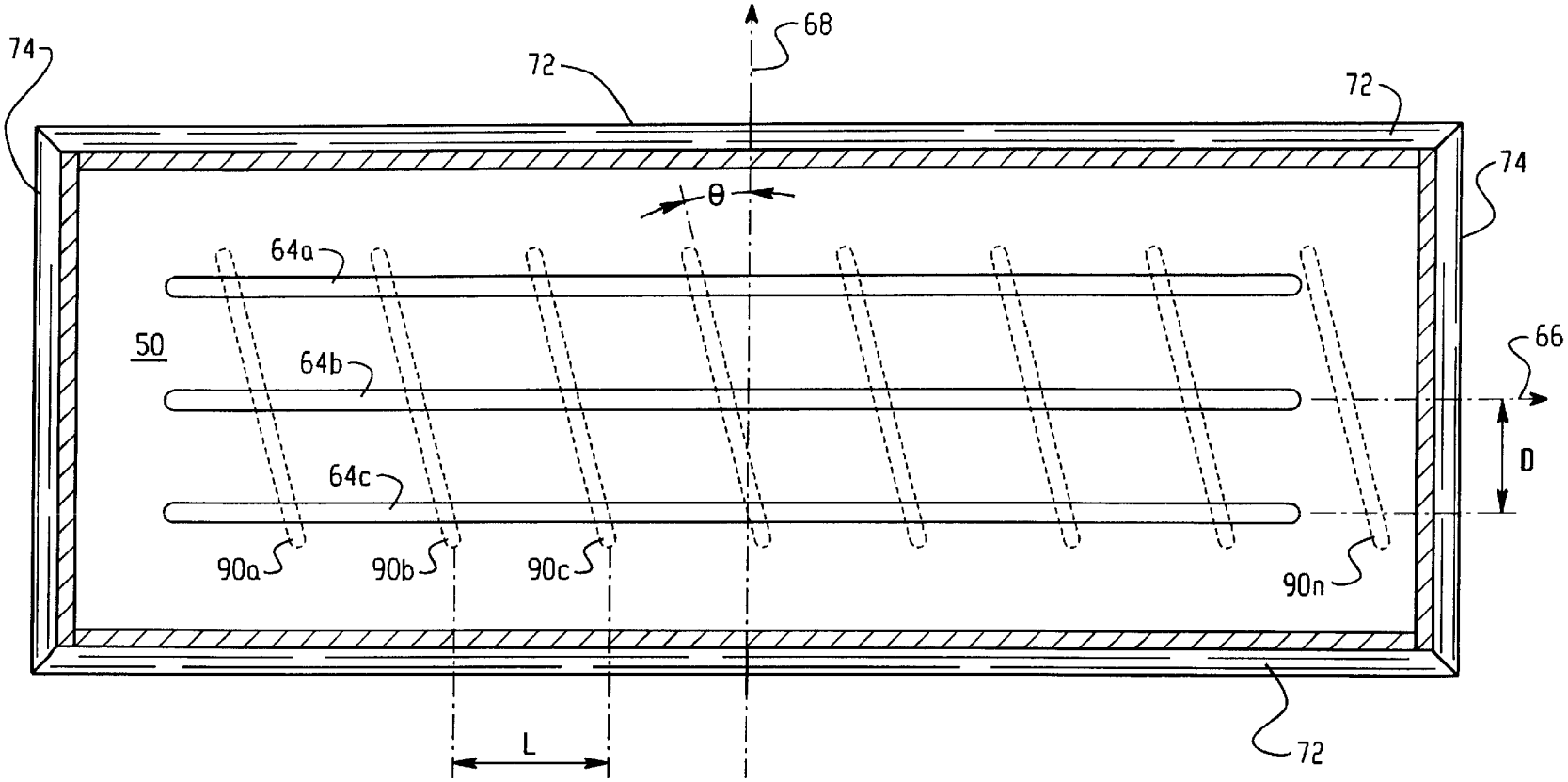
FIG. 4 is a side sectional view of the ion source of FIG. 2, taken along the lines 4—4 of FIG. 2.
Figures 5, 5A:
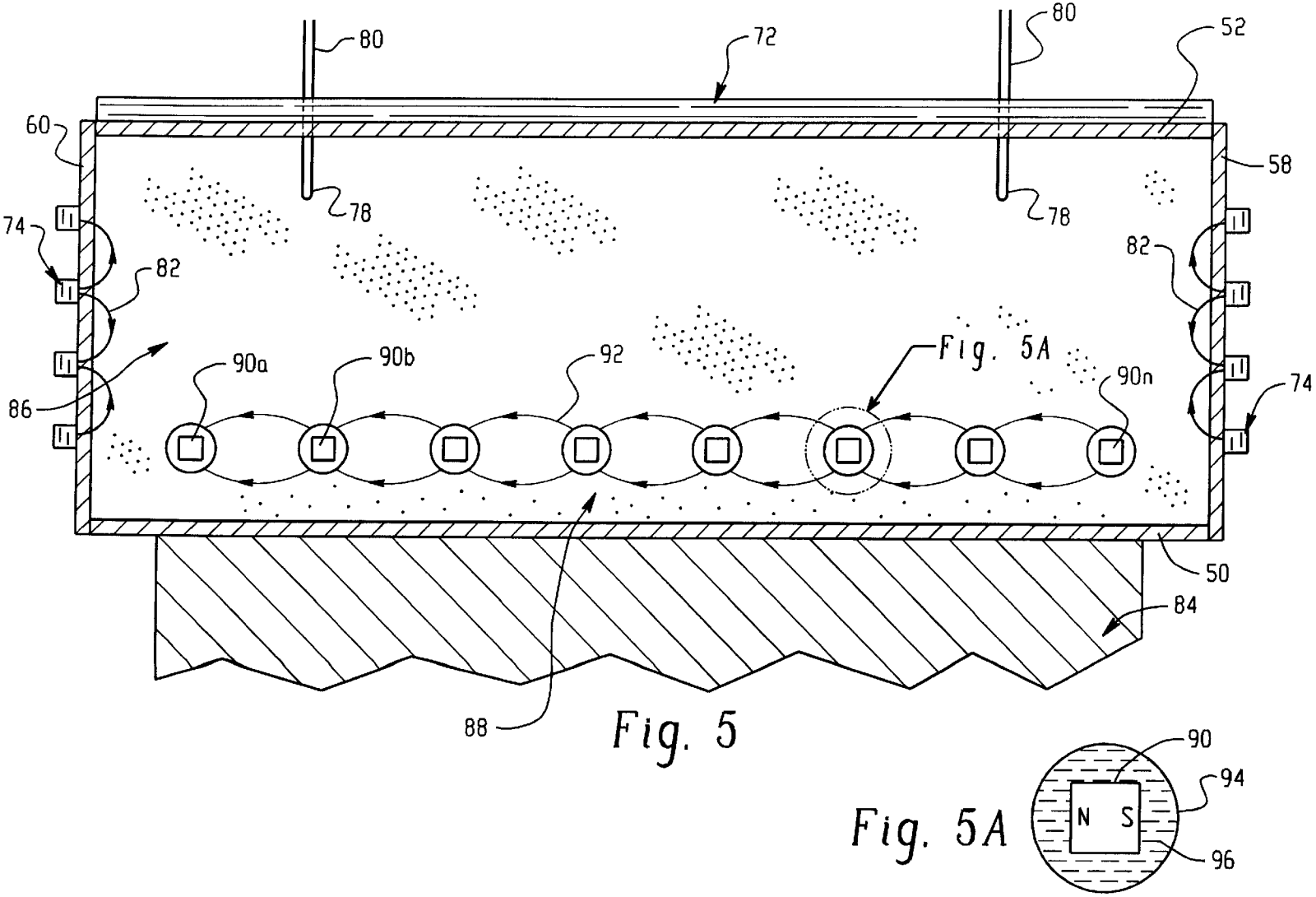
FIG. 5 is an end sectional view of the ion source of FIG. 2, taken along the lines 5—5 of FIG. 2.
FIG. 5A is an expanded view of an internal ion source magnet shown in FIG. 5.

Each of the elongated apertures 64 has a high aspect ratio, that is, the length of the aperture or slot along a longitudinal axis 66 greatly exceeds the width of the aperture along an orthogonal axis 68 (perpendicular to axis 66). Both axes 66 and 68 lie in the same plane as front wall 50 and, hence, the same plane as the elongated apertures 64. Generally, the length of the aperture (along axis 66) is at least fifty times the width of the aperture (along axis 68). Such a high aspect ratio (e.g. in excess of 50:1) forms a ribbon ion beam, which is particularly suitable for implanting large surface area workpieces. FIG. 2A shows an alternative embodiment of the front wall 50 of the ion source 26, wherein each of the elongated apertures 64 comprises a plurality of linearly arranged smaller circular openings 70. The ion source is provided with elongated bar magnets 72 and 74 positioned adjacent the exterior surfaces 54 and 58, respectively. Bar magnets 72 extend generally parallel to the longitudinal axis 66 and generally perpendicular to the orthogonal axis 68. Bar magnets 74 extend generally parallel to the orthogonal axis 68 and generally perpendicular to the longitudinal axis 66. Although not shown in FIG. 2, bar magnets 72 of similar shape and configuration are disposed on back wall 52 and bottom wall 56, extending parallel to the bar magnets 72 on top wall 54. Also not shown in FIG. 2, bar magnets 74 of similar shape and configuration are disposed on side wall 60, extending parallel to the bar magnets 74 on side wall 58. These magnets, the purpose of which is better explained below, are shown in FIGS. 3–5.

Figure 3:
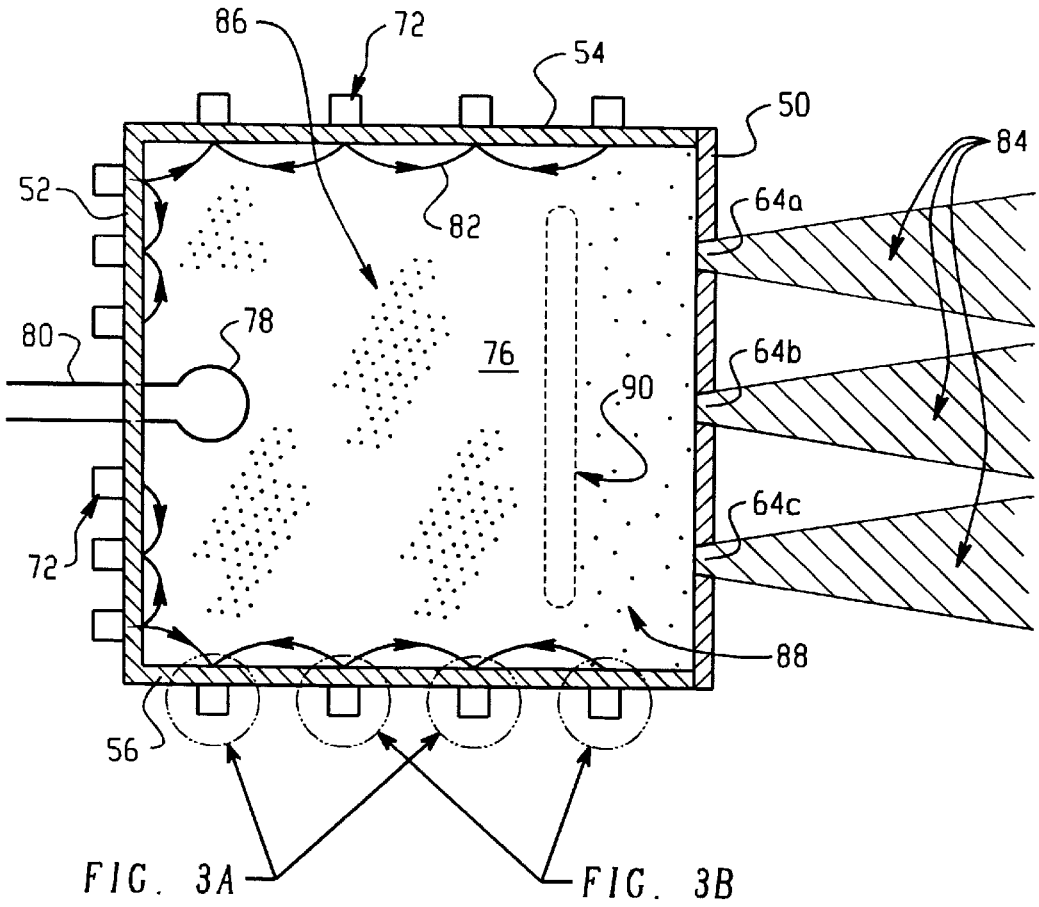
FIG. 3 is a side cross sectional view of the ion source of FIG. 2, taken along the lines 3—3 of FIG. 2.

As shown in FIG. 3, the walls of the ion source form the chamber 76 in which plasma is generated in the following manner. As is known in the art, source gas is introduced into the chamber 76 through an inlet (not shown) and ionized by a pair of coil shaped filaments or exciters 78 which are electrically excited through electrical leads 80. The exciters are each comprised of a tungsten filament which when heated to a suitable temperature thermionically emits electrons. Ionizing electrons may also be generated using radio frequency (RF) excitation means, such as an RF antenna. The electrons interact with and ionize the source gas to form a plasma within the plasma chamber.

Figure 3A:
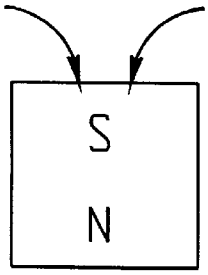
FIGS. 3A and 3B are expanded views of external magnets of the ion source shown in FIG. 3.
Figure 3B:
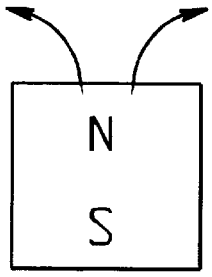

The plasma is confined within the plasma chamber 76 and urged toward the center thereof by the bar magnets 72, which are oriented parallel to the longitudinal axis 66 of the elongated slots 64. As shown in FIGS. 3A and 3B, the bar magnets 72 are polarized so that the north and south poles of each magnet run the length of the magnet (rather than being polarized end-to-end). Resulting field lines 82, running from north to south poles of adjacent magnets 72, create a multi-cusp type field that urges the plasma toward the center of the chamber 76.

Extractor electrodes (not shown) located outside the plasma chamber 76 extract the plasma through the elongated apertures 64, as is known in the art. This extracted plasma forms an ion beam 84 which is conditioned and directed toward the target panel As noted above, beam portions output by apertures located between surrounding apertures overlap the beam portions output by those surrounding apertures to form the total beam output.

An example of a source gas, which is ionized in the chamber 76, is phosphine ($PH_3$) that may be diluted with hydrogen. The resulting phosphine plasma comprises $PH_n^+$ ions and $P^+$ ions. In addition to the $PH_n^+$ ions and $P^+$ ions, the ionization process occurring within the plasma chamber 76 results in the generation of hydrogen ($H_n^+$) ions and high energy electrons. The hydrogen ions are sometimes undesirable for implantation into the target panel as they may cause unwanted heating and subsequent damage to the panel.

The plasma chamber 76 is divided into a primary region 86 and a filtered or secondary region 88 separated by a magnetic filter 90. As shown in FIG. 4, the magnetic filter 90 comprises a plurality of bar magnets 90*a* through 90*n*. The magnetic filter 90 (i) improves plasma confinement in the primary region 86, resulting in a higher plasma density, and (ii) prevents the passage of high energy electrons from the primary region to the secondary region 88, resulting in a lower electron energy (and thus, temperature) in the secondary region. These two effects have an impact on the relative proportions of $PH_n^+$ and $H_n^+$ in the respective regions, with an increased proportion of $PH_n^+$ ions and $P^+$ ions in the secondary region of the plasma confinement chamber.

As shown in FIG. 5A, the magnets 90 are magnetized in the same manner and orientation as magnets 72, that is, they are polarized so that the north and south poles of each magnet run the length of the magnet (rather than being polarized end-to-end). The magnets are polarized in the same direction so that opposing poles face each other. As such, magnetic field lines 92 extend between opposing poles of adjacently positioned magnets, as shown in FIG. 5. The magnetic field lines produce a multi-cusp type field that serves to separate the plasma into the primary and secondary regions within the plasma chamber. As such, the magnets 90 function as a filter which impedes the passage of higher energy electrons from the primary region 86 to the secondary region 88 of chamber 76. The ion beam is then drawn from the secondary region 88.

Referring back to FIG. 5A, the magnets 90 are positioned within elongated tubes 94 which are filled with a suitable cooling fluid 96 such as water. As shown in FIGS. 4 and 5, the magnets 90 are arranged within the chamber 76 so that they lie parallel to each other, and at an angle θ with respect to axis 68. A distance L, as measured parallel to axis 66, separates parallel adjacent magnets 90. A distance D (see FIGS. 4 and 6) separates parallel adjacent elongated apertures 64. The relevance of these dimensions is explained below with respect to FIGS. 6 and 7.

Figure 6:
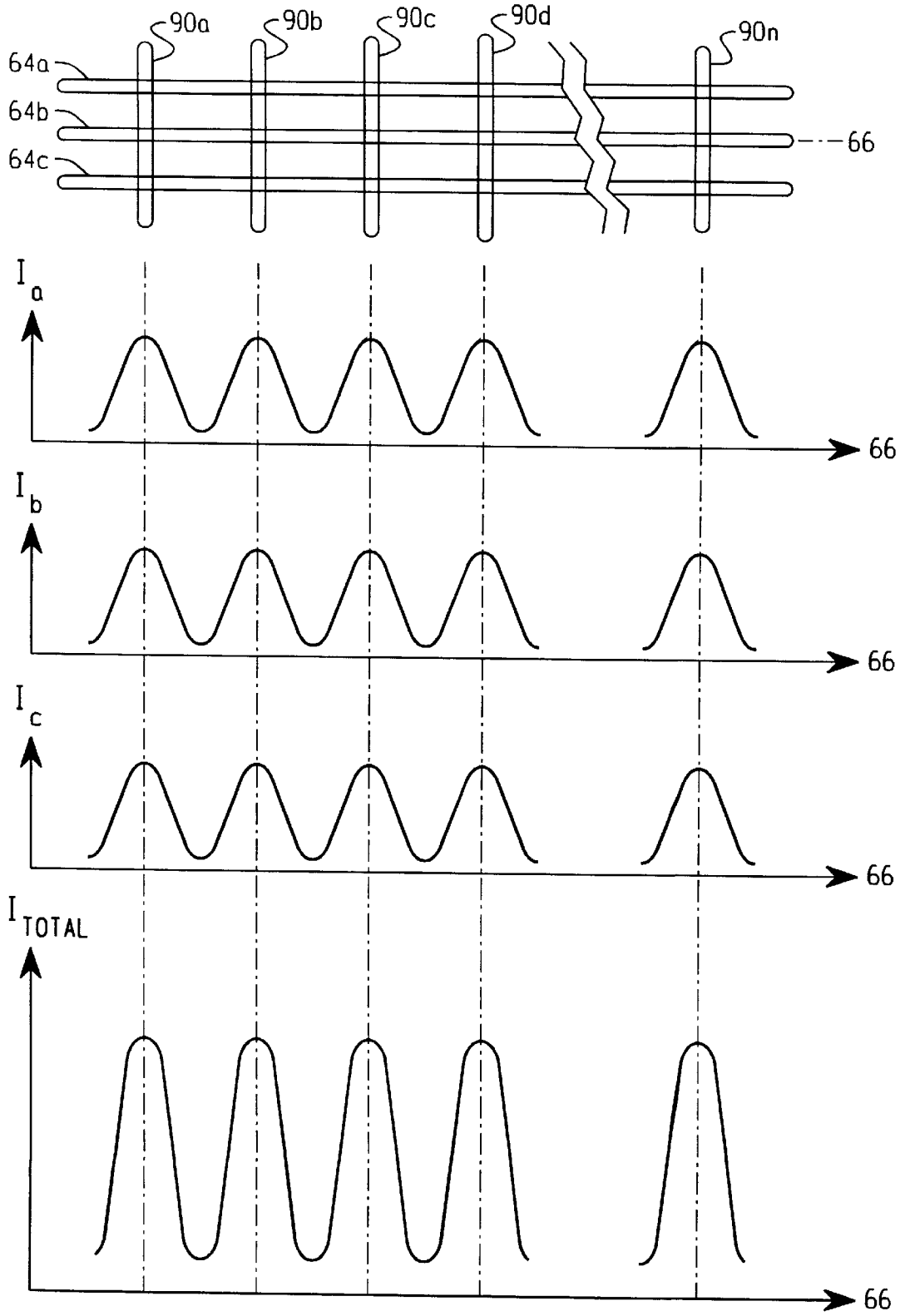
FIG. 6 is a graphical representation of ion source output beam current provided by a ribbon beam ion source magnet configuration.
Figure 7:
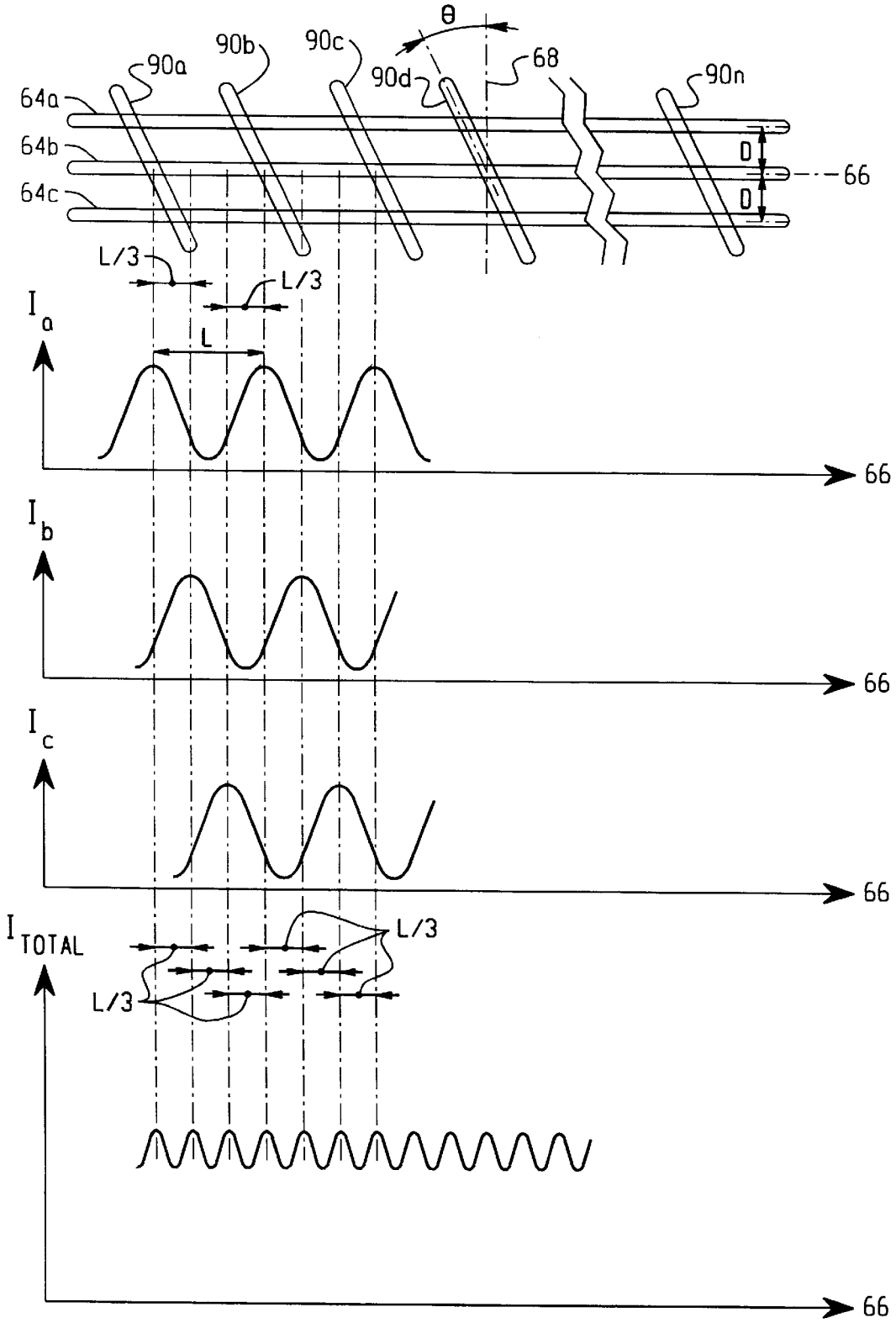
FIG. 7 is a graphical representation of ion source output beam current provided by the ion source magnet configuration of the present invention.

As shown in FIGS. 6 and 7, each of the elongated apertures 64*a*–64*c* outputs a portion of the current ($I_a$ through $I_c$, respectively) which combines to form the total current profile ($I_{total}=I_a+I_b+I_c$)of the ion beam 84 along axis 66. In a ribbon beam configured implantation system, the beam current profile along axis 66 is critical because it directly determines the implant dose profile of the workpiece in the direction orthogonal to the scan direction. The magnetic field emanating from the magnetic filter comprised of bar magnets 90*a*–90*n* produces variations in the ion current profile extracted from any individual elongated aperture. In FIG. 6, a ribbon beam magnet arrangement wherein the bar magnets 90*a*–90*n* are oriented orthogonal to the elongated slots 64*a*–64*c*, the individual current output profiles $I_a$ through $I_c$ are identically oriented along longitudinal axis 66. Each of these individual profiles has current output variations at the locations along axis 66, which correspond to the axes of the bar magnets 90*a*–90*n*, based on the magnetic field created by the magnets. Because the total ion beam current $I_{total}$ is cumulative of the individual currents $I_a$ through $I_c$, these individual aligned variations add to produce an ion beam of non-uniform current density along the longitudinal axis 66.

In FIG. 7, however, the magnets are oriented at an angle θ with respect to axes 68 and 66, and lie in a plane within plasma chamber 76 that is parallel to front wall 50. Angle θ is an acute angle as measured from either of axes 66 or 68. As in FIG. 6, each of the individual current profiles maintains current variations at the locations along axis 66 which corresponds to the axes of the bar magnets 90*a*–90*n*, based on the magnetic field created by the magnets. However, because the magnets are oriented at an angle θ with respect to axis 68, the magnetic field emanating from the magnetic filter comprised of bar magnets 90*a*–90*n* shifts the individual current output profiles $I_a$ through $I_c$ a distance L/3 along longitudinal axis 66, as compared to FIG. 6. As a result, the total ion beam current $I_{total}$, which is cumulative of the shifted waveforms $I_a$ through $I_c$, is more uniform in density along the longitudinal axis 66 (i.e., the "peaks" of each individual current output profile tends to fill in the "troughs" of the other two current output profiles. For optimum current density uniformity, the variables N (number of elongated slots 64), D (the distance between adjacent slots 64), L (the distance between adjacent bar magnets 90 as measured parallel to axis 66), and the angle θ (as measured from axis 68) are chosen to satisfy the following equation:

$$L/D=N\times(\tan\theta)$$

In the disclosed embodiment the L/D ratio is approximately 1.4, N=3, and θ=25° (tan θ=0.466). It is contemplated, however, that this formula is described only for exemplary purposes, and that other values for these variables may be substituted in the practice of the present invention. Of particular importance is that the bar magnets 90*a*–90*n* lie canted, or transverse, to the axes 66 and 68, and do not lie orthogonal to either of these axes.

Accordingly, a preferred embodiment of an improved magnetic filter for an ion source has been described. With the foregoing description in mind, however, it is understood that this description is made only by way of example, that the invention is not limited to the particular embodiments described herein, and that various rearrangements, modifications, and substitutions may be implemented with respect to the foregoing description without departing from the scope of the invention as defined by the following claims and their equivalents.

I claim:

1. A magnetic filter (90) for an ion source (26) comprising a housing defining a plasma confinement chamber (76) in which a plasma including ions is generated by ionizing a source material, the housing including a generally planar wall (50) in which are formed a plurality of elongated apertures (64) through which an ion beam (84) may be extracted from the plasma, the plurality of elongated openings oriented substantially parallel to each other and to a first axis (66) which lies within said planar wall, the first axis being substantially orthogonal to a second axis (68) which lies within the planar wall; said magnetic filter comprising:

a plurality of elongated magnets (90*a*–90*n*) disposed within the plasma confinement chamber (76) for separating the plasma confinement chamber into a primary region (86) and a secondary region (88), said plurality of elongated magnets being oriented neither parallel to nor orthogonal to said second axis (68) but instead oriented at an acute angle θ as measured from said second axis (68) and lying parallel to each other and within a plane which is generally parallel to the generally planar wall (50).

2. The magnetic filter (90) of claim 1, wherein each of said plurality of elongated aperture openings (64) comprises a plurality of linearly arranged smaller circular openings.

3. The magnetic filter (90) of claim 1, wherein said elongated magnets (90*a*–90*n*) are positioned within elongated tubes (94) which are filled with a cooling fluid (96).

4. The magnetic filter (90) of claim 3, wherein said cooling fluid (96) is water.

5. The magnetic filter (90) of claim 1, wherein said acute angle θ is approximately 25°.

6. An ion source (26), comprising:

a housing defining a plasma confinement chamber (76) in which a plasma including ions is generated by ionizing a source material, said housing including a generally planar wall (50) in which are formed a plurality of elongated apertures (64) through which an ion beam (84) may be extracted from the plasma, said plurality of elongated openings oriented substantially parallel to each other and to a first axis (66) which lies within said planar wall, said first axis being substantially orthogonal to a second axis (68) which lies within said planar wall; and a magnetic filter (90) disposed within said plasma confinement chamber for separating said plasma confinement chamber (76) into a primary region (86) and a secondary region (88), said magnetic filter comprising a plurality of elongated magnets (90*a*–90*n*) oriented neither parallel to nor orthogonal to said second axis (68) but instead oriented at an acute angle θ as measured from said second axis (68) and lying parallel to each other and within a plane which is generally parallel to said generally planar wall (50).

7. The ion source (26) of claim 6, wherein the ion source outputs a ribbon ion beam.

8. The ion source (26) of claim 7, wherein a width of the ion beam output by the ion source is made adjustable by selecting the number and width of apertures (64).

9. The ion source (26) of claim 8, wherein each of said elongated apertures (64) has an aspect ratio of at least 50:1.

10. The ion source (26) of claim 6, wherein said elongated magnets (90*a*–90*n*) are positioned within elongated tubes (94) which are filled with a cooling fluid (96).

11. The ion source (26) of claim 6, wherein said plasma confinement chamber (76) is provided with a plurality of elongated bar magnets (72) positioned adjacent the exterior surfaces thereof, for urging plasma contained therein toward the center thereof.

12. The ion source (26) of claim 6, wherein said acute angle θ is approximately 25°.

13. The ion source (26) of claim 6, wherein said plasma confinement chamber (76) has an interior surface which is lined with graphite.

14. The ion source (26) of claim 6, wherein the source material ionized within the ion source housing is phosphine ($PH_3$) gas diluted with hydrogen (H), wherein the plasma comprises $PH_n^+$ ions, $P^+$ ions, and $H_n^+$ ions, and wherein the magnetic filter (90) generally confines a higher proportion of $PH_n^+$ ions and $P^+$ ions in the secondary region (88) of the plasma confinement chamber than in the primary region (86).

15. A magnetic filter (90) for an ion source (26) comprising a housing defining a plasma confinement chamber (76) in which a plasma including ions is generated by ionizing a source material, the housing including a generally planar wall (50) in which are formed a plurality of elongated apertures (64) through which an ion beam (84) may be extracted from the plasma, the plurality of elongated openings oriented substantially parallel to each other and to a first axis (66) which lies within said planar wall, the first axis being substantially orthogonal to a second axis (68) which lies within the planar wall; said magnetic filter comprising:

a plurality of elongated magnets (90*a*–90*n*) disposed within the plasma confinement chamber (76) for separating the plasma confinement chamber into a primary region (86) and a secondary region (88), each of said plurality of magnets being oriented at an angle θ as measured from said second axis (68) and lying parallel to each other and within a plane which is generally parallel to the generally planar wall (50);

wherein said plurality of elongated apertures (64) equals N apertures, adjacent apertures of said plurality of elongated apertures are each separated by a distance D, and adjacent magnets of said plurality of elongated magnets (90*a*–90*n*) are each separated by distance L as measured parallel to said first axis (66), said angle θ being generally defined by the equation: L/D=N×(tan θ).

16. The magnetic filter (90) of claim 15, wherein L/D is approximately 1.4, N=3, and θ=25°.

17. An ion source (26), comprising:

a housing defining a plasma confinement chamber (76) in which a plasma including ions is generated by ionizing a source material, said housing including a generally planar wall (50) in which are formed a plurality of elongated apertures (64) through which an ion beam (84) may be extracted from the plasma, said plurality of elongated openings oriented substantially parallel to each other and to a first axis (66) which lies within said planar wall, said first axis being substantially orthogonal to a second axis (68) which lies within said planar wall; and a magnetic filter (90) disposed within said plasma confinement chamber for separating said plasma confinement chamber (76) into a primary region (86) and a secondary region (88), said magnetic filter comprising a plurality of elongated magnets (90*a*–90*n*) each oriented at an angle θ as measured from said second axis (68) and lying parallel to each other and within a plane which is generally parallel to said generally planar wall (50);

wherein said plurality of elongated apertures (64) equals N apertures, adjacent apertures of said plurality of elongated apertures are each separated by a distance D, and adjacent magnets of said plurality of elongated magnets (90*a*–90*n*) are each separated by distance L as measured parallel to said first axis (66), said angle θ being generally defined by the equation: L/D=N×(tan θ).

18. The ion source (26) of claim 17, wherein L/D is approximately 1.4, N=3, and θ=25°.

* * * * *